US011715446B2

(12) United States Patent
Wu

(10) Patent No.: US 11,715,446 B2
(45) Date of Patent: Aug. 1, 2023

(54) MUSIC CLASSIFICATION METHOD AND BEAT POINT DETECTION METHOD, STORAGE DEVICE AND COMPUTER DEVICE

(71) Applicant: GUANGZHOU BAIGUOYUAN INFORMATION TECHNOLOGY CO., LTD., Guangzhou (CN)

(72) Inventor: Xiaojie Wu, Guangzhou (CN)

(73) Assignee: BIGO TECHNOLOGY PTE, LTD., Singapore (SG)

( * ) Notice: Subject to any disclaimer, the term of this patent is extended or adjusted under 35 U.S.C. 154(b) by 477 days.

(21) Appl. No.: 16/960,692

(22) PCT Filed: Dec. 4, 2018

(86) PCT No.: PCT/CN2018/119112
§ 371 (c)(1),
(2) Date: Jul. 8, 2020

(87) PCT Pub. No.: WO2019/137115
PCT Pub. Date: Jul. 18, 2019

(65) Prior Publication Data

US 2020/0357369 A1 Nov. 12, 2020

(30) Foreign Application Priority Data

Jan. 9, 2018 (CN) ..... 201810019193.3

(51) Int. Cl.

| | |
|---|---|
| ***G10H 1/00*** | (2006.01) |
| ***G10L 25/18*** | (2013.01) |
| ***G10L 25/21*** | (2013.01) |

(52) U.S. Cl.
CPC ..... *G10H 1/0008* (2013.01); *G10L 25/18* (2013.01); *G10L 25/21* (2013.01); *G10H 2210/056* (2013.01); *G10H 2210/076* (2013.01)

(58) Field of Classification Search
CPC ..... G10H 1/0008; G10H 2210/056; G10H 2210/076; G10L 25/18
(Continued)

(56) References Cited

U.S. PATENT DOCUMENTS 4,860,624 A * 8/1989 Dinnan ..... G10H 1/20 84/613
6,448,487 B1 * 9/2002 Smith ..... G10H 3/186 84/613
(Continued)

FOREIGN PATENT DOCUMENTS

CN 101599271 A 12/2009
CN 101652807 A 2/2010
(Continued)

OTHER PUBLICATIONS

Extended European search report of counterpart EP application No. 18900195.1 dated Jan. 27, 2021.
(Continued)

*Primary Examiner* — Christina M Schreiber

(57) ABSTRACT

A music beat point detection method includes: performing a frame processing on a music signal to obtain a frame signal; obtaining a power spectrum of the frame signal; performing sub-band decomposition on the power spectrum, and decomposing the power spectrum into at least two sub-bands; performing a time-frequency domain joint filtering on a signal of each sub-band according to a beat type corresponding to each sub-band; obtaining a to-be-confirmed beat point from the frame signal of the music signal according to a result of the time-frequency domain joint
(Continued)

filtering; and obtaining a beat point of the music signal according to a power value of the to-be-confirmed beat point.

15 Claims, 3 Drawing Sheets

(58) Field of Classification Search
USPC ..... 84/609
See application file for complete search history.

(56) References Cited

U.S. PATENT DOCUMENTS 6,542,869 B1 * 4/2003 Foote ..... G06F 16/634 704/E15.005
7,485,797 B2 * 2/2009 Sumita ..... G10H 1/383 84/669
8,618,401 B2 * 12/2013 Kobayashi ..... G10H 1/0008 84/613
9,040,805 B2 * 5/2015 Kobayashi ..... G10H 1/38 84/649
9,454,948 B2 * 9/2016 Horvath ..... G10H 1/00
2005/0211072 A1 * 9/2005 Lu ..... G10H 1/40 84/612
2006/0048634 A1 * 3/2006 Lu ..... G10H 1/40 84/612
2006/0152678 A1 * 7/2006 Hung ..... G10H 1/40 704/E11.001
2007/0157795 A1 * 7/2007 Hung ..... G10H 1/0008 84/600
2007/0163425 A1 * 7/2007 Tsui ..... G10H 3/125 84/609
2007/0240558 A1 * 10/2007 Seppanen ..... G10H 1/40 84/636
2008/0034948 A1 * 2/2008 Sumita ..... G10H 1/0008 84/636
2010/0246842 A1 * 9/2010 Kobayashi ..... G10H 1/0008 381/61
2012/0132056 A1 * 5/2012 Wang ..... G06F 16/683 84/609
2012/0143679 A1 * 6/2012 Bernosky ..... G06F 16/683 707/765
2014/0366710 A1 * 12/2014 Eronen ..... G10H 1/00 84/609
2015/0068389 A1 * 3/2015 Sugano ..... G06F 16/639 84/611
2015/0094835 A1 * 4/2015 Eronen ..... G10H 1/0008 700/94
2016/0005387 A1 * 1/2016 Eronen ..... G10H 1/40 84/611
2020/0327898 A1 * 10/2020 Lou ..... G10H 1/40
2020/0357369 A1 * 11/2020 Wu ..... G10H 1/40
2022/0293136 A1 * 9/2022 Wang ..... H04N 21/8113

FOREIGN PATENT DOCUMENTS

CN 102754147 A 10/2012
CN 104346147 A 2/2015
CN 104620313 A * 5/2015 ..... G10H 1/40
CN 104620313 A 5/2015
CN 105513583 A 4/2016
CN 107545883 A 1/2018
CN 108320730 A 7/2018
CN 109256146 A * 1/2019 ..... G10L 25/06
KR 2013051386 A * 5/2013
WO 2007072394 A2 6/2007
WO WO-2007072394 A2 * 6/2007 ..... G10H 1/40
WO WO-2019128639 A1 * 7/2019 ..... G10H 1/40

OTHER PUBLICATIONS

Notice of allowance of Russian application No. 2020126263 dated Dec. 15, 2020.
Lukasik Ewa, Application oriented insights into the Gabor transform for acoustic signals processing; 1996 8th European Signal Processing Conference (EUSIPCO 1996), Sep. 10, 1996, p. 2, paragraphs 2.1,3,4; figure 3, example (2); table bottom of p. 2.
Examination report of Indian Patent Application No. 202047032336 dated Nov. 12, 2021.
Chinese Office Action for Chinese application CN201810019193.3 (filed Jan. 9, 2018, published Jul. 24, 2018), dated Oct. 2018.

* cited by examiner

MUSIC CLASSIFICATION METHOD AND BEAT POINT DETECTION METHOD, STORAGE DEVICE AND COMPUTER DEVICE

CROSS-REFERENCE TO RELATED APPLICATION

This application is a 371 of PCT Application No. PCT/CN2018/119112, filed on Dec. 4, 2018, which claims priority to Chinese Patent Application No. 201810019193.3, filed on Jan. 9, 2018 and entitled "MUSIC CLASSIFICATION METHOD AND BEAT POINT DETECTION METHOD, STORAGE DEVICE AND COMPUTER DEVICE", the entire contents of which are incorporated herein by reference.

TECHNICAL FIELD

The present disclosure relates to the field of Internet technologies, in particular to a music classification method, a beat point detection method, a storage device and a computer device.

BACKGROUND

With rapid development of the Internet technologies and live video technologies, the music effect is added while a short video is played or a live video is performed. In order to improve the user's experience, a video special effect group suitable for a piece of music may be recommended to the user according to the type of the music in the video, and the audio appeal and the visual appeal of the video are strengthened.

SUMMARY

The objective of the present disclosure is to provide a music classification method, a beat point detection method, a storage device and a computer device.

The present disclosure provides the technical solution as follows:

a music beat point detection method, including: performing a frame processing on a music signal to obtain a frame signal; obtaining a power spectrum of the frame signal; performing sub-band decomposition on the power spectrum, and decomposing the power spectrum into at least two sub-bands; performing a time-frequency domain joint filtering on a signal of each sub-band according to a beat type corresponding to each sub-band; obtaining a to-be-confirmed beat point from the frame signal of the music signal according to a result of the time-frequency domain joint filtering; and obtaining a beat point of the music signal according to a power value of the to-be-confirmed beat point.

A music classification method based on a beat point of music, including: performing a frame processing on a music signal to obtain a frame signal; obtaining a power spectrum of the frame signal; performing sub-band decomposition on the power spectrum, and decomposing the power spectrum into at least two sub-bands; performing a time-frequency domain joint filtering on a signal of each sub-band according to a beat type corresponding to each sub-band; obtaining a to-be-confirmed beat point from the frame signal of the music signal according to a result of the time-frequency domain joint filtering; obtaining a beat point of the music signal according to a power value of the to-be-confirmed beat point; and classifying the music signal according a number of the beat points in each sub-band.

A storage device, storing a plurality of instructions, wherein the instructions are adapted to be loaded and executed by a processor: performing a frame processing on a music signal to obtain a frame signal; obtaining a power spectrum of the frame signal; performing sub-band decomposition on the power spectrum, and the power spectrum is decomposed into at least two sub-bands; performing a time-frequency domain joint filtering on a signal of each sub-band according to a beat type corresponding to each sub-band; obtaining a to-be-confirmed beat point from the frame signal of the music signal according to a result of the time-frequency domain joint filtering; and obtaining the beat point of the music signal according to a power value of the to-be-confirmed beat point, or the instructions are adapted to be loaded and executed by the processor: performing a frame processing on a music signal to obtain a frame signal; obtaining a power spectrum of the frame signal; performing sub-band decomposition on the power spectrum, and decomposing the power spectrum into at least two sub-bands; performing a time-frequency domain joint filtering on a signal of each sub-band according to a beat type corresponding to each sub-band; obtaining a to-be-confirmed beat point from the frame signal of the music signal according to a result of the time-frequency domain joint filtering; obtaining a beat point of the music signal according to a power value of the to-be-confirmed beat point; and classifying the music signal according a number of the beat points in each sub-band.

A computer device, including: one or more processors; a memory; and one or more application programs, stored in the memory and configured to be executed by the one or more processors; wherein the one or more application programs is configured to be used for executing the music beat point detection method according to any one of the aforesaid embodiments or is configured to be used for executing the music classification method according to any one of the aforesaid embodiments.

BRIEF DESCRIPTION OF THE DRAWINGS

The above and/or additional aspects and advantages of the present disclosure will become apparent and easily understood from the following description of the embodiments with reference to the accompanying drawings, in which.

DETAILED DESCRIPTION

Figure 1:
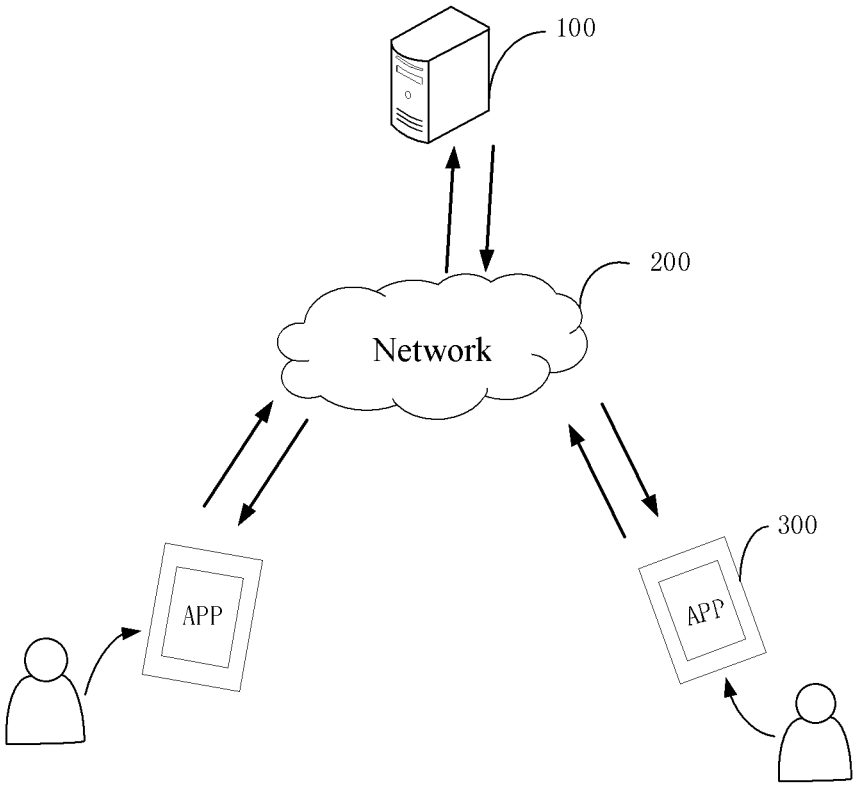
FIG. 1 is an interaction schematic diagram between a server and clients according to an embodiment of the present disclosure.

A description will be made in detail to the embodiments of the present disclosure, examples of which are illustrated in the accompanying drawings. The reference numbers which are the same or similar throughout the accompanying drawings represent the same or similar elements or elements with the same or similar functions. The embodiments described below with reference to the accompanying drawings are intended to be illustrative only, and are not to be construed as limitations to the present disclosure.

In the traditional video special effect processing process, beat points of the playing music cannot be obtained, and thus the corresponding video special effect cannot be triggered according to the beat points of the playing music. Therefore, during processing of the video special effect, personalized setting of the special effect cannot be performed according to the playing music in the video, and thus the satisfaction of user experience is influenced.

In the music beat point detection method provided by the present disclosure, the frame processing is performed on a music signal firstly and a power spectrum of each frame signal is obtained, and thus sub-band decomposition is performed on each power spectrum. Time-frequency domain joint filtering is performed on different sub-bands according to beat types corresponding to the sub-bands. To-be-confirmed beat points can be obtained according to filtering results, and then beat points of the music signal is determined according to a power value of each to-be-confirmed beat point. Therefore, the beat points of the music signal can be obtained by the music beat point detection method disclosed by the present disclosure, and thus a video special effect in the special effect group can be triggered in combination with the beat points, and the satisfaction of user experience is improved.

Furthermore, in the music beat point detection method, the beat confidence level of each frequency in each sub-band signal is obtained, and a weighted sum value of the power values corresponding to all the frequencies in each sub-band is calculated by the beat confidence level to obtain the to-be-confirmed beat points according to the weighted sum value. Therefore, the accuracy of the to-be-confirmed beat points can be further improved.

Meanwhile, in the music beat point detection method, the power spectrum of each frame signal is decomposed into a first sub-band used for detecting beat points of a base drum, a second sub-band used for detecting beat points of a snare drum, a third sub-band used for detecting the beat points of the snare drum and a fourth sub-band used for detecting beat points of a high-frequency beat instrument. Therefore, the detection method can perform sub-band decomposition according to types of concrete beat points in the music, and thus the beat points in the music signal can be more accurately detected.

In the following, the technical solutions of the present disclosure will be introduced through several embodiments.

A music beat point detection method and a music beat point based music classification method provided by the present disclosure are applied to an application environment as shown in FIG. 1.

As shown in FIG. 1, a server 100 and clients 300 are in one network 200 environment and perform data information interaction through the network 200. The number of the server 100 and the number of the clients 300 are not limited, and the number of the server 100 and the number of the clients 300 as shown in FIG. 1 are exemplary only. An APP (Application) is installed in each client 300. A user may perform information interaction with the corresponding server 100 by the APP in the client 300.

Each server 100 may be, but not limited to, a network server, a management server, an application server, a database server, a cloud server and the like. Each client 300 may be, but not limited to, a smart phone, a personal computer (PC), a tablet personal computer, a personal digital assistant (PDA), a mobile Internet device (MID) and the like. An operating system of each client 300 may be, but not limited to, Android system, IOS (iPhone operating system), Windows phone system, Windows system and the like.

After the user clicks to select or uploads a piece of music (song) in a video APP of the client 300, the server 100 analyzes and estimates the music, further issues and recommends a video special effect group suitable for the music (song) to the client 300, where the user is located, according to an estimated music type and triggers a video special effect in the special effect group at the time position of the estimated beat point. In the music beat point detection method provided by the present disclosure, the beat point of the music uploaded or selected by the user is detected. Therefore, the corresponding video special effect may be triggered according to the beat point of the music, and the satisfaction of user's experience is improved.

Figure 2:
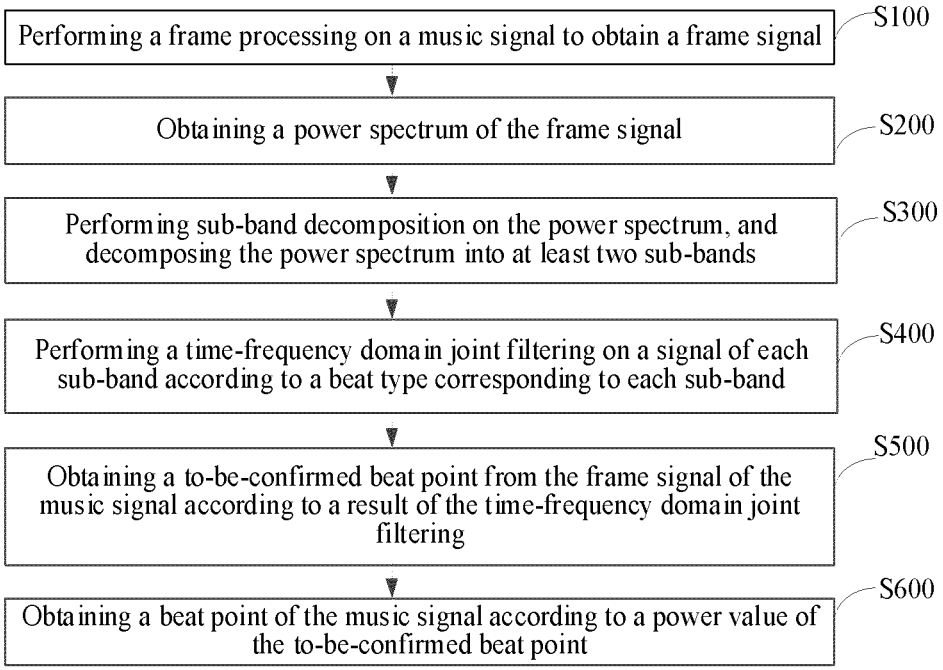
FIG. 2 is a flowchart of the music beat point detection method according to an embodiment of the present disclosure.

The present disclosure provides a music beat point detection method. In one embodiment, as shown in FIG. 2, the music beat point detection method of the present disclosure includes the following steps:

S100, a frame processing is performed on a music signal to obtain frame signals.

In the embodiment, the server obtains the music signal to be detected and performs the frame processing on the music signal to obtain a plurality of frame signals of the music signal. The music signal may be a music signal uploaded by the user or a music signal in a database of the server.

In one embodiment, the server performs preprocessing on the input music signal firstly. The preprocessing process includes the necessary preprocessing operations such as decoding of the input music signal, conversion of dual channel to single channel, sampling rate conversion, removal of direct-current components and the like. The preprocessing process here belongs to normal operation and is not explained in detail here. Furthermore, the server performs frame processing on the music signal which has been performed the preprocessing to obtain a plurality of frame signals.

S200, power spectra of the frame signals are obtained.

In the embodiment, the server further obtains the power spectrum of each frame signal after obtaining the plurality of frame signals of the music signal. Specifically, when the server performs the frame processing on the music signal, N points are one frame, and M points are updated each time (M is smaller than N, M/N is equal to 0.25 to 0.5), and overlap=N−M.

After the frame processing, a windowing processing is performed on each signal having a frame size of N points, and then FFT (Fast Fourier Transformation) is performed on each signal to obtain the power spectrum P (t, k) of each frame signal. The power spectrum obtaining process belongs to normal operation in signal processing and is not explained in detail here.

S300, sub-band decomposition is performed on the power spectrum, and the power spectrum is decomposed into at least two sub-bands.

In the embodiment, the server performs sub-band decomposition on the power spectrum corresponding to each frame signal and decomposes each power spectrum into at least two sub-bands. Each sub-band is used for detecting a corresponding one type of beat point. Specifically, the server analyzes a frequency spectrum of the music signal and performs the sub-band decomposition on the music signal in combination with the characteristic of the frequency response of a common beat type instrument in music.

In one embodiment, the sub-band decomposition is performed on the power spectrum, and the power spectrum is decomposed into four sub-bands; and the four sub-bands include a first sub-band used for detecting beat points of a base drum, a second sub-band used for detecting beat points of a snare drum, a third sub-band used for detecting the beat points of the snare drum and a fourth sub-band used for detecting beat points of a high-frequency beat instrument. A frequency band of the first sub-band is 0 Hz to 120 Hz, a frequency band of the second sub-band is 120 Hz to 3K Hz, a frequency band of the third sub-band is 3K Hz to 10K Hz, and a frequency band of the fourth sub-band is 10K Hz to fs/2 Hz, wherein fs is a sampling frequency of the signal.

In the embodiment, decomposition on a sub-band frequency band of the power spectrum is mainly due to the situation that besides the base drum and the snare drum are greatly different from other beat type instruments (for example, high-frequency beat instruments) in frequency response, durations of different beat type instruments also have large differences, energy of the base drum mainly concentrates on a low frequency sub-band, but non-beat type instruments such as a bass often exist in the low frequency sub-band, and the duration of the bass is much longer than that of the base drum. Energy of the snare drum mainly concentrates on an intermediate frequency sub-band, but a sub-band with a frequency band below 3 k Hz is disturbed by signals of human voice and the like, and a sub-band with a frequency band above 3 k Hz is mainly disturbed by other accompaniment musical instruments. The duration of the snare drum is obviously shorter than that of other interference signals on the two intermediate frequency sub-bands, but the duration of an interference signal of the sub-band with the frequency band below 3 k Hz is obviously different from that of an interference signal of the sub-band with the frequency band above 3 k Hz, and thus different strategies need to be adopted when the time-frequency domain joint filtering is performed. High frequency sub-bands are often sounds of melodic accompaniment musical instruments having very long durations, which is different from characteristics of the accompaniment musical instruments and human voices occur in the intermediate frequency sub-band.

S400, a time-frequency domain joint filtering is performed on a signal of each sub-band according to a beat type corresponding to each sub-band.

In the embodiment, the server further performs a time-frequency domain joint filtering on the signal of each sub-band according to the beat type corresponding to each sub-band after performing the sub-band decomposition on the power spectrum corresponding to each frame signal. Specifically, the server performs the time-frequency domain joint filtering on the signal of each sub-band by adopting parameters corresponding to beat types according to the detected beat types corresponding to the first sub-band, the second sub-band, the third sub-band and the fourth sub-band when the power spectrum of the frame signal is decomposed into the four sub-bands in the step S300. The parameters corresponding to the beat types are determined as follows: the parameters of the sub-band are set according to characteristics at time and on a harmonic distribution of beat points of beat-like instruments used for detection and other interference signals that are different from the beat points in each sub-band.

In the step, when the server adopts the parameters corresponding to beat types to perform the time-frequency domain joint filtering on the signal of each sub-band, the parameters corresponding to the beat types may be parameters obtained according to the characteristics at time and on a harmonic distribution of beat points of beat-like instruments used for detection and other interference signals that are different from the beat points before the music beat point detection method disclosed by the present disclosure is implemented. Or the parameters corresponding to the beat types may be parameters obtained by the server according to the characteristics at time and on a harmonic distribution of beat points of beat-like instruments used for detection and other interference signals that are different from the beat points while the music beat point detection method disclosed by the present disclosure is implemented.

In the embodiment, the specific steps of time-frequency domain joint filtering may be described as follows:

as for a signal P (t, k) of a current frame, signals of hi frames before and signals of hi frames after are taken to make up one time domain window [P(t-hi, k), . . . , P(t+hi, k)] for each frequency Bin k, and a proper smoothing window wi is selected on the window to smooth the window and obtain P_smt (t, k); and hj Bins before and hj Bins after are taken to make up one frequency domain window [P(t, k−hj), . . . , P(t, k+hj)] for each frequency Bin k and for the signal P (t, k) of the current frame, and a proper smoothing window wj is selected on the window to smooth the window and obtain P_smf (t, k).

Optionally, for different sub-bands, the above operation steps of time-frequency domain joint filtering are the same, but parameter values of hi and hj are different. Selection of the parameters of hi and hj are collectively decided by the characteristics in duration and on harmonic distribution of interference signals of beat type instruments and other melodic interference signals, which fall in different sub-bands. As for each frequency Bin k, the parameters set by the sub-band are selected to filter according to the sub-band to which the frequency Bin k belongs.

Mean filtering, median filtering, Gaussian window filtering or the like may be selected for the smoothing windows wi and wj. In the embodiment of the present disclosure, the frame signals are mainly smoothed (with low-pass filtering) jointly in a time-frequency domain, and other filtering modes may also be adopted in other embodiments.

S500, to-be-confirmed beat points are obtained from the frame signals of the music signal according to a result of the time-frequency domain joint filtering.

Figure 3:
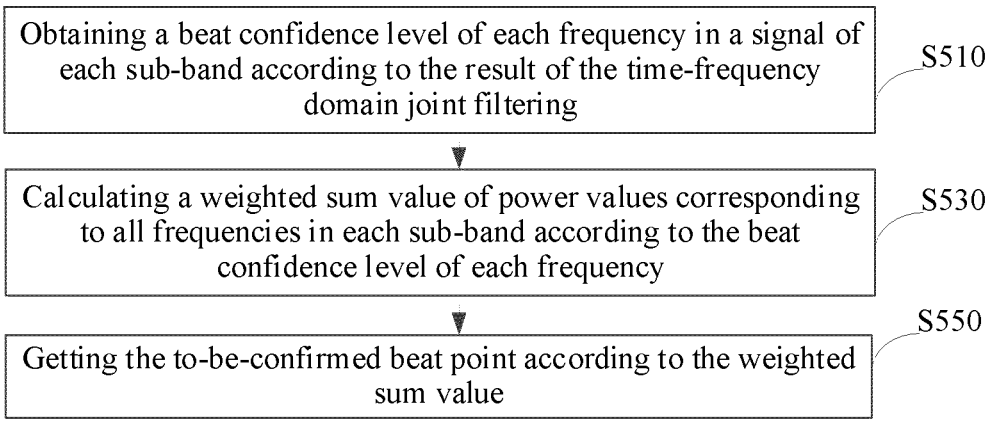
FIG. 3 is a flowchart of a step S500 according to an embodiment of the present disclosure.

In the embodiment, the server may obtain the to-be-confirmed beat points from the frame signals of the music signal according to the result of the time-frequency domain joint filtering. In one embodiment, as shown in FIG. 3, the step S500 includes the following steps:

S510, a beat confidence level of each frequency in a signal of each sub-band is obtained according to the result of the time-frequency domain joint filtering;

S530, a weighted sum value of the power values corresponding to all the frequencies in each sub-band is calculated according to the beat confidence level of each frequency; and S550, the to-be-confirmed beat point is obtained according to the weighted sum value.

In one embodiment, the beat confidence level of each frequency and other non-beat melodic beat confidence levels in the signal of each sub-band may be calculated as follows:

as for a signal P (t, k) of a current frame and each frequency k, whether it is a confidence level of one beat (i.e. Wiener filtering) may be given according to the result of the time-frequency domain joint filtering, wherein k represents frequency; and B (t, k)=P_smf(t, k)*P_smf (t, k)/(P_smf (t, k)*P_smf (t, k)+P_smt (t, k)*P_smt (t, k)).

Accordingly, whether it is the confidence level of one melodic component is as follows:

H (t, k)=P_smt (t, k)*P_smt (t, k)/(P_smf (t, k)*P_smf (t, k)+P_smt (t, k)*P_smt (t, k))=1−B (t,k).

Furthermore, weighted sum is performed on the signal P (t, k) of the current frame in following manners according the type of the beat point.

Kick(t)=sum(P(t, k)*B(t, k)), k∈ sub-band 1 (the first sub-band) and is used for detecting the base drum;

Snare(t)=sum(P(t, k)*B(t, k)), k∈ sub-bands 2 and 3 (the second and third sub-band and are used for detecting the snare drum; and Beat(t)=sum(P(t, k)*B(t, k)), k∈ sub-band 4 (the fourth sub-band) and is used for detecting other beat points.

P (t, k) is a power spectrum obtained after STFT (Short Time Fourier Transform) is performed on the signal, P (t, k)*B (t, k) embodies weighting of the power spectrum, and B (t, k) represents a confidence level whether the signal is the beat confidence level at a frequency k in a frame t. The confidence level is a numerical value between 0 and 1, and is multiplied by the power spectrum of the signal, the power spectrum P (t, k), belonging to a beat, can be kept, and the power spectrum P (t, k), not belonging to the beat, can be inhibited (the numerical value becomes small after the confidence level is multiplied by the power spectrum of the signal).

After weighting, the weighted power spectra are summed, and summation is performed on k according to the sub-band division condition. For example, as for time t=t1, P (t1, k), after STFT analysis, a value range of k is 1−N/2+1, that is P (t1, 1), P (t1, 2) . . . P (t1, N/2+1) numbers exist, the frequency corresponding to each frequency k is k*fs/N. Therefore, we can also know that k belongs to which sub-band. For example, k belongs to the sub-band 1 (base drum sub-band) when it is equal to 1-10, and k belongs to the sub-band 2 (snare drum sub-band) when it is equal to 20-50, and so on; and then summation of P (t1, 1)*B (t1, 1), P (t1, 2)*B (t1, 2) . . . P (t1, 10)*B (t1, 10) is weighted summation on the sub-band 1 (base drum sub-band), and kick (t1) is obtained. The above processing is performed on all the frames would obtain kick (1), kick (2) . . . kick (L), and the size of L is decided by the specific length of the music signal.

S600, the beat points of the music signal are obtained according to power values of the to-be-confirmed beat points.

In the embodiment, the server obtains the beat points of the music signal according to the power values corresponding to the beat points, after obtaining the to-be-confirmed beat points. Specifically, as described in the step S500, the server further obtains to-be-confirmed beat points whose weighted sum value is larger than a threshold power value and takes the to-be-confirmed beat points as the beat points of the music signal, after obtaining the weighted sum value of power values corresponding to all the frequencies in each sub-band by calculation. That is, a to-be-confirmed beat point whose weighted sum value is larger than a threshold power value is taken as the beat point of the music signal. The threshold power value is determined as follows: a mean value and a variance of the power values of all the to-be-confirmed beat points are obtained, and a sum value of the mean value and the doubled variance is calculated and serves as the threshold power value. That is, a sum value of the mean value and a doubled variance is taken as the threshold power value.

In a specific embodiment, as for Kick, Snare and Beat (Kick, Snare and Beat are abbreviation expressions of Kick (t), Snare (t) and Beat (t) respectively) obtained in the step S500, they are scanned respectively to find all peak points, and the peak points with the power values larger than the threshold power value T1=mean+std*2 (mean represents a mean value of the power values of all the peak points, and std represents a variance of the power values of all the peak points) are detected beat points. The beat points are marked as the base drum if being detected in Kick, marked as the snare drum if being detected in Snare and marked as other beat points (beat points of a high-frequency beat instrument) if being detected in Beat.

In the music beat point detection method provided by the present disclosure, the frame processing is performed on a music signal firstly and a power spectrum of each frame signal is obtained, and thus sub-band decomposition is performed on the power spectrum. Time-frequency domain joint filtering is performed on different sub-bands according to beat types corresponding to the sub-bands. To-be-confirmed beat points can be obtained according to filtering results, and then beat points of the music signal are determined according to a power value of each to-be-confirmed beat point. Therefore, the beat points of the music signal can be obtained by the music beat point detection method disclosed by the present disclosure, and thus a video special effect in the special effect group can be triggered in combination with the beat points, and the satisfaction of user experience is improved.

Furthermore, in the music beat point detection method, the beat confidence level of each frequency in each sub-band signal is obtained, and a weighted sum value of the power values corresponding to all the frequencies in each sub-band is calculated by the beat confidence level to obtain the to-be-confirmed beat points according to the weighted sum value. Therefore, the accuracy of the to-be-confirmed beat points can be further improved.

Meanwhile, in the music beat point detection method, the power spectrum of each frame signal is decomposed into a first sub-band used for detecting beat points of a base drum, a second sub-band used for detecting beat points of a snare drum, a third sub-band used for detecting the beat points of the snare drum and a fourth sub-band used for detecting beat points of a high-frequency beat instrument. Therefore, the detection method may perform sub-band decomposition according to types of concrete beat points in the music, and thus the beat points in the music signal can be more accurately detected.

In an embodiment, after the step S600, the music beat point detection method further includes:

a strong beat point of the music signal is obtained according to a strong beat point threshold power value; and a weak beat point of the music signal is obtained, and the weak beat point is determined as follows:

a beat point with the power value smaller than or equal to the strong beat point threshold power value and larger than the threshold power value in the beat points of the music signal is obtained and gets the weak beat point of the music signal.

Optionally, the strong beat point threshold power value is determined as follows: a mean value and a variance of the power values of all the to-be-confirmed beat points are obtained, and a sum value of the mean value and a triple variance is calculated and serves as the strong beat point threshold power value.

Specifically, as described in the step S600, a beat point with the power value of the peak point larger than a strong beat point threshold power value T2 (T2=mean+std*3) is the strong beat point; a beat point with the power value of the peak point smaller than the strong beat point threshold power value and larger than or equal to a threshold power value T1 (T1=mean+std*2) is the weak beat point; and the position of the beat point is a frame t corresponding to the found peak point.

Figure 4:
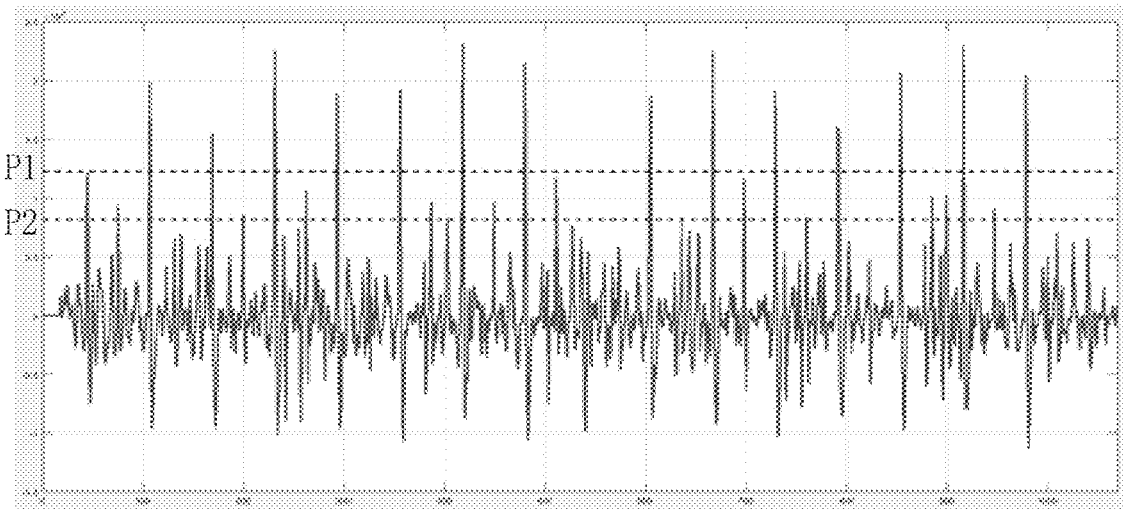
FIG. 4 is a snare drum signal diagram obtained after a step S500 according to an embodiment of the present disclosure.

To sum up, as shown in FIG. 4, the present disclosure gives the snare drum signal diagram obtained after the step S500 according to an embodiment of the present disclosure. The horizontal axis represents time t, the vertical axis represents power P, and the power P here is the weighted sum value obtained according to the step S500. As shown in FIG. 4, a plurality of peaks exist on a signal curve, and all the peak points on the curve may be obtained by scanning. P1 represents the strong beat point threshold power value, and P2 represents the threshold power value. As for the peak points obtained by scanning, the power values of the peak points must be larger than P2 so as to be detected, beats corresponding to the peak points with the power values larger than P2 and smaller than P1 belong to the weak beat points, and beats corresponding to the peak points with the power values larger than P1 belong to the strong beat points; and the peak points with the power value smaller than P2 would be discarded.

According to the solution provided by the present disclosure, the positions of the beat points and the beat types and the music types in the music (song) are analyzed, a very important skeleton in the music, that is, beats are automatically extracted, and triggering times and triggering types of the video special effect are guided by the extracted positions of the beat points, beat types and music types to enable the music to be well combined with the video special effect and to meet people's habits when they see and listen music. This part of work originally required someone to manually mark the beat points and the types in the music and was very tedious. By using the method described by the present disclosure, machine types of the beat points in the music may be automatically marked, and it is found by experiment that the accuracy may reach 90 percent or above.

The present disclosure further provides a music classification method based on music beat point. The method includes the steps: the beat points of the music signal are detected by using the music beat point detection method as described in any one of the embodiments; and the music signal is classified according to the number of the beat points in each sub-band.

That classifying the music signal according to the number of the beat points in each sub-band includes: the number of the beat points of the snare drum and the number of the beat points of the base drum in the music signal are counted according to the number of the beat points in each sub-band. The music signal is classified as strong rhythm music if the number of the beat points of the snare drum and the number of the beat points of the base drum are larger than a first threshold; and the music signal is classified as lyric music if the number of the beat points of the base drum is smaller than a second threshold.

Specifically, the music types may be classified by using the number of the aforementioned three types of beat points in the music beat point detection method. The music with the beat points of the snare drum and the beat points of the base drum larger than a threshold 1 at the same time is of the type of music with strong rhythm sensation. The music with the beat points of the base drum smaller than a threshold 2 is of the type of the lyric music. The threshold 1 and the threshold 2 are set according to the number of the beat points of the snare drum and the number of the beat points of the base drums in music classification.

In application, the music type is roughly sorted into the two types of the music with strong rhythm sensation and the lyric music, entirely different special effect types may be discriminatively used. Therefore, over intense special effects in the lyric music are avoided from being largely triggered, and the special effects are facilitated to keep consistent with the seeing and listening habits of the people.

The present disclosure further provides a storage device in which a plurality of instructions are stored; the instructions are adapted to be loaded and executed by a processor: the frame processing is performed on the music signal to obtain frame signals; power spectra of the frame signals are obtained; sub-band decomposition is performed on the power spectra, and the power spectrum is decomposed into at least two sub-bands; time-frequency domain joint filtering is performed on a signal of each sub-band according to a beat type corresponding to each sub-band; to-be-confirmed beat points are obtained from the frame signals of the music signal according to a result of the time-frequency domain joint filtering; and the beat points of the music signal are obtained according to power values of the to-be-confirmed beat points;

or the instructions are adapted to be loaded or executed by the processor: the beat points of the music signal are detected by using the music beat point detection method as described in any one of the embodiments; and the music signal is classified according to the number of the beat points in each sub-band.

Furthermore, the storage device may be various media capable of storing program codes, such as a U disk, a mobile hard disk, ROM (Read-Only Memory), a RAM, a disk or an optical disk.

In other embodiments, the instructions in the storage device provided by the present disclosure are loaded by the processor, and the steps described in the music beat point detection method disclosed in any one of the embodiments are executed by the processor. Or, the instructions in the storage device provided by the present disclosure are loaded by the processor, and the music classification method described in any one of the embodiments are executed by the processor.

The present disclosure further provides a computer device. The computer device includes one or more processors, a memory and one or more applications. The one or more applications is stored in the memory, and is configured to be executed by the one or more processors and is configured to be used for executing the music beat point detection method or the music classification method described in any one of the embodiments in the device.

Figure 5:
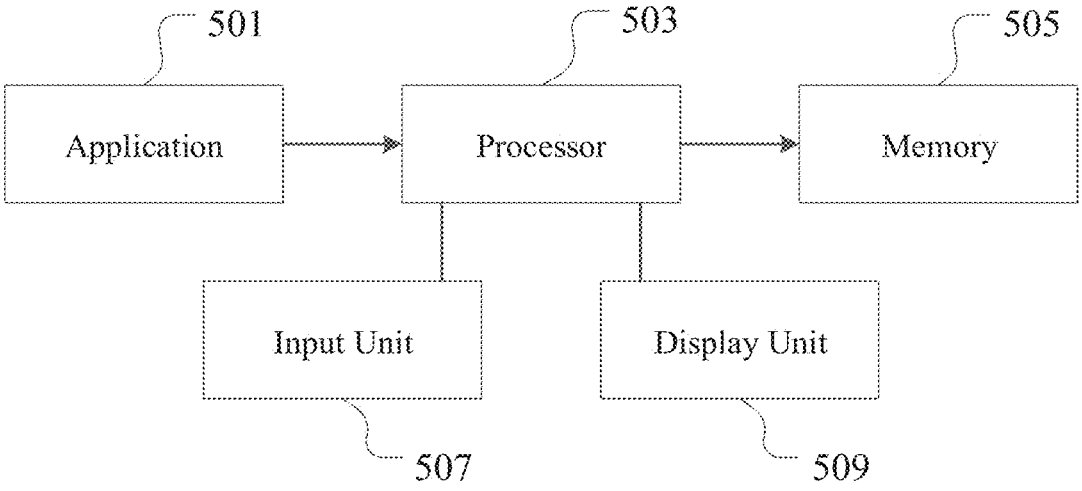
FIG. 5 is a structural schematic diagram of a computer device according to an embodiment of the present disclosure.

FIG. 5 is a structural schematic diagram of a computer device according to an embodiment of the present disclosure. The device described in the embodiment may be the computer device, for example, a server, a personal computer and a network device. As shown in FIG. 5, the device includes a processor 503, a memory 505, an input unit 507 and a display unit 509 and other devices. Those skilled in the art may appreciate that the devices of the equipment structure illustrated in FIG. 5 do not limit all the devices which may include more or fewer components as shown in figures, or have combinations of certain components. The memory 505 may be used for storing applications 501 and various function modules, the processor 503 runs the applications 501 stored in the memory 505, and thus various function applications and data processing of the device are executed. The memory may be an internal memory or an external memory or includes both of them. The internal memory may include a read only memory (ROM), a programmable ROM (PROM), an electrically programmable ROM (EPROM), an electrically erasable and programmable ROM (EEPROM), a flash memory or a random access memory. The external memory may include a hard disk, a floppy disk, a ZIP disk, a U disk, a magnetic tape and the like. The memory disclosed by the present disclosure includes, but not limited to, the memories of these types. The memory disclosed by the present disclosure is given merely as an example and not as a way of limitation.

The input unit 507 is used for receiving input of the signals and receiving keywords input by the user. The input unit 507 may include a touch panel and other input devices. The touch panel may collect touch operations on or near it (such as the user's operations on or near the touch panel by using any suitable objects or accessories, such as a finger and a stylus, etc.), a corresponding connecting device is driven according to a preset program; and the other input device may include but not limited to one or more of a physical keyboard, function keys (such as a playing control key and a switch button), a trackball, a mouse, an operating lever and the like. The display unit 509 may be used for displaying information input by the user or information provided to the user and various menus of the computer device. The display unit 509 may take the form of a liquid crystal display, an organic light-emitting diode and the like. The processor 503 is a control center of the computer device, the processor 503 connects various portions of the whole computer by using various interfaces and lines, and executes various functions and processes data by running or executing software programs and/or modules stored in the memory 503 and calling data stored in the memory.

In an embodiment, the device includes one or more processors 503, one or more memories 505 and one or more applications 501. The one or more applications 501 is stored in the memories 505 and is configured to be executed by the one or more processors 503 and is configured to be used for executing the music beat point detection method or the music classification method described in the embodiment.

Additionally, various function units in various embodiments of the present disclosure may be integrated into one processing module, each unit may physically exist singly, and two or more units may also be integrated into one processing module. The integrated modules may be implemented in the form of hardware and may also be implemented in the form of a software function module. The integrated modules may be stored in a computer-readable storage medium if being implemented in the form of the software function module and sold or used as an independent product.

It will be appreciated by those of ordinary skill in the art that all or a part of the steps of implementing the embodiments described above may be accomplished by hardware or may also be accomplished by programs instructing related hardware. The programs may be stored in one computer-readable storage medium, the storage medium may include the memory, a magnetic disk, an optical disk or the like.

The above description is only some embodiments of the present disclosure, and it should be noted that those skilled in the art may also make several improvements and modifications without departing from the principles of the present disclosure which should be considered as the scope of protection of the present disclosure.

The invention claimed is:

1. A music beat point detection method, comprising:

performing a frame processing on a music signal to obtain a frame signal;

obtaining a power spectrum of the frame signal;

performing sub-band decomposition on the power spectrum, and decomposing the power spectrum into at least two sub-bands;

performing a time-frequency domain joint filtering on a signal of each sub-band according to a beat type corresponding to each sub-band;

obtaining a beat confidence level of each frequency in a signal of each sub-band according to a result of the time-frequency domain joint filtering;

calculating a weighted sum value of power values corresponding to all frequencies in each sub-band according to the beat confidence level of each frequency;

getting a to-be-confirmed beat point according to the weighted sum value; and obtaining a beat point of the music signal according to a power value of the to-be-confirmed beat point.

2. The music beat point detection method according to claim 1, wherein the obtaining the beat point of the music signal according to the power value of the to-be-confirmed beat point comprises:

taking a to-be-confirmed beat point whose weighted sum value is larger than a threshold power value as the beat point of the music signal.

3. The music beat point detection method according to claim 2, wherein the threshold power value is determined as follows:

obtaining a mean value and a variance of power values of all to-be-confirmed beat points; and taking a sum value of the mean value and a doubled variance as the threshold power value.

4. The music beat point detection method according to claim 3, wherein after the taking a to-be-confirmed beat point whose weighted sum value is larger than a threshold power value as the beat point of the music signal, the music beat point detection method further comprises:

obtaining a strong beat point of the music signal according to a strong beat point threshold power value; and obtaining a beat point whose power value is smaller than or equal to the strong beat point threshold power value and is larger than the threshold power value in the beat points of the music signal and getting the weak beat point of the music signal.

5. The music beat point detection method according to claim 4, wherein the strong beat point threshold power value is determined as follows:

obtaining the mean value and the variance of the power values of all the to-be-confirmed beat points; and taking a sum value of the mean value and a triple variance as the strong beat point threshold power value.

6. The music beat point detection method according to claim 1, wherein the performing sub-band decomposition on the power spectrum and decomposing the power spectrum into at least two sub-bands comprises:

performing sub-band decomposition on the power spectrum, and decomposing the power spectrum into four sub-bands;

wherein the four sub-bands comprise a first sub-band used for detecting a beat point of a base drum, a second sub-band used for detecting a beat point of a snare drum, a third sub-band used for detecting the beat point of the snare drum and a fourth sub-band used for detecting a beat point of a high-frequency beat instrument, and a frequency band of the second sub-band is different from a frequency band of the third sub-band.

7. The music beat point detection method according to claim 6, wherein a frequency band of the first sub-band is 0 Hz to 120 Hz, a frequency band of the second sub-band is 120 Hz to 3K Hz, a frequency band of the third sub-band is 3K Hz to 10K Hz, a frequency band of the fourth sub-band is 10K Hz to fs/2 Hz, wherein fs is a sampling frequency of the signal.

8. The music beat point detection method according to claim 6, wherein the performing the time-frequency domain joint filtering on the signal of each sub-band according to the beat type corresponding to each sub-band comprises:

according to a detected beat type corresponding to the first sub-band, the second sub-band, the third sub-band and the fourth sub-band, performing the time-frequency domain joint filtering on the signal of each sub-band by adopting a parameter corresponding to the beat type.

9. The music beat point detection method according to claim 8, wherein the parameter corresponding to the beat type is determined as follows:

setting a parameter of the sub-band according to characteristics at time and on a harmonic distribution of beat points of beat-like instruments used for detection and other interference signals in each sub-band.

10. A computer device, comprising:

one or more processors;

a memory; and one or more application programs, stored in the memory and configured to be executed by the one or more processors;

wherein the one or more application programs is configured to be used for executing the music beat point detection method according to claim 1.

11. A music classification method based on a beat point of music, comprising:

performing a frame processing on a music signal to obtain a frame signal;

obtaining a power spectrum of the frame signal;

performing sub-band decomposition on the power spectrum, and decomposing the power spectrum into at least two sub-bands;

performing a time-frequency domain joint filtering on a signal of each sub-band according to a beat type corresponding to each sub-band;

obtaining a beat confidence level of each frequency in a signal of each sub-band according to a result of the time-frequency domain joint filtering;

calculating a weighted sum value of power values corresponding to all frequencies in each sub-band according to the beat confidence level of each frequency;

getting a to-be-confirmed beat point according to the weighted sum value;

obtaining a beat point of the music signal according to a power value of the to-be-confirmed beat point; and classifying a music signal according a number of the beat point in each sub-band.

12. The music classification method according to claim 11, wherein the classifying the music signal according the number of the beat point in each sub-band comprises:

counting a number of beat point of the snare drum and a number of the beat point of the base drum in the music signal according to a number of the beat point in each sub-band;

classifying the music signal as strong rhythm music if the number of the beat point of the snare drum and the number of the beat point of the base drum are larger than a first threshold; and classifying the music signal as lyric music if the number of the beat point of the base drum is smaller than a second threshold.

13. A computer device, comprising:

one or more processors;

a memory; and one or more application programs, stored in the memory and configured to be executed by the one or more processors;

wherein the one or more application programs is configured to be used for executing the music classification method according to claim 11.

14. A storage device storing a plurality of instructions, wherein the instructions are loaded and executed by a processor to perform the music classification method according to claim 11.

15. A storage device storing a plurality of instructions, wherein the instructions are loaded and executed by a processor:

performing a frame processing on a music signal to obtain a frame signal;

obtaining a power spectrum of the frame signal;

performing sub-band decomposition on the power spectrum, and the power spectrum is decomposed into at least two sub-bands;

performing a time-frequency domain joint filtering on a signal of each sub-band according to a beat type corresponding to each sub-band;

obtaining a beat confidence level of each frequency in a signal of each sub-band according to a result of the time-frequency domain joint filtering;

calculating a weighted sum value of power values corresponding to all frequencies in each sub-band according to the beat confidence level of each frequency;

getting a to-be-confirmed beat point according to the weighted sum value; and obtaining the beat point of the music signal according to a power value of the to-be-confirmed beat point.

* * * * *